US009837000B2

(12) United States Patent
Haddad

(10) Patent No.: US 9,837,000 B2
(45) Date of Patent: Dec. 5, 2017

(54) ILLUMINATED SIGN APPARATUS

(71) Applicant: Salim D. Haddad, Troy, MI (US)

(72) Inventor: Salim D. Haddad, Troy, MI (US)

( * ) Notice: Subject to any disclaimer, the term of this patent is extended or adjusted under 35 U.S.C. 154(b) by 0 days.

(21) Appl. No.: 15/472,789

(22) Filed: Mar. 29, 2017

(65) Prior Publication Data

US 2017/0287370 A1 Oct. 5, 2017

Related U.S. Application Data

(60) Provisional application No. 62/315,747, filed on Mar. 31, 2016.

(51) Int. Cl.

| | |
|---|---|
| ***G09F 13/18*** | (2006.01) |
| ***G09F 13/04*** | (2006.01) |
| ***G09F 13/08*** | (2006.01) |
| ***G09F 13/22*** | (2006.01) |

(52) U.S. Cl.

CPC ..... *G09F 13/0404* (2013.01); *G09F 13/08* (2013.01); *G09F 13/22* (2013.01); *G09F 2013/0445* (2013.01); *G09F 2013/222* (2013.01)

(58) Field of Classification Search

CPC .... G09F 13/04; G09F 13/22; G09F 2013/222; G09F 13/20; G09F 13/0404; G09F 9/33; F21Y 2115/10; F21Y 2101/00; F21Y 2105/10; F21V 3/02; F21V 29/004; G02B 6/0095; G02B 6/0073

USPC ..... 40/564

See application file for complete search history.

(56) References Cited

U.S. PATENT DOCUMENTS

| | | | | |
|---|---|---|---|---|
| 3,197,902 | A * | 8/1965 | Buzan | G02B 6/0076 250/458.1 |
| 3,309,806 | A | 3/1967 | Gallagher | |
| 4,970,816 | A | 11/1990 | Trame | |
| 6,056,416 | A * | 5/2000 | Ngai | F21S 8/06 362/225 |
| 6,367,179 | B1 * | 4/2002 | Marsh | G09F 13/04 313/25 |
| 6,594,931 | B1 | 7/2003 | Barton et al. | |
| 7,467,486 | B2 | 12/2008 | Kaoh | |
| 8,375,613 | B2 | 2/2013 | Spiro | |
| 8,984,780 | B2 | 3/2015 | Brassell et al. | |
| 2004/0004827 | A1 | 1/2004 | Guest | |
| 2015/0325157 | A1 * | 11/2015 | Jumblatt | G09F 19/205 40/581 |

* cited by examiner

*Primary Examiner* — Shin Kim

(74) *Attorney, Agent, or Firm* — Burris Law, PLLC

(57) ABSTRACT

A sign apparatus of the present disclosure includes a light source operable to emit light, a front panel having a front portion and a side portion, and a rear panel attached to the front panel and having a back portion, a side portion and a rim portion. The rear panel and the front panel define a cavity where the light source is housed. The side portion of the front panel extends between the cavity and the side portion of the rear panel, and the rim portion of the rear panel is configured to follow a contour of the front panel, extend beyond a periphery of the front panel, and have opaque properties.

20 Claims, 5 Drawing Sheets

ILLUMINATED SIGN APPARATUS

CROSS-REFERENCE TO RELATED APPLICATIONS

This application claims the benefit of U.S. Provisional Application No. 62/315,747 filed on Mar. 31, 2016. The entire disclosure of the above application is incorporated by reference.

FIELD

The present disclosure relates to illuminated signs. More particularly, to signage having multiple panels.

BACKGROUND

It is common practice for organizations, such as banks, restaurants, and educational institutions, to have an illuminated sign mounted outside or inside of their facility. Such signs are typically designed to identify and attract consumers and/or clients to the organization.

Generally, an illuminated sign apparatus can include one or more light sources for illuminating the front face of the sign, and for also creating a glowing halo around the sign. While the illumination allows a viewer to see the sign from a distance, light from the different illuminated regions may blend causing the sign apparatus to appear dull and unclear, and thus, diminishing the brightness and clarity of the sign apparatus. This and other issues related to the performance and characteristics of a sign apparatus are addressed by the present disclosure.

SUMMARY

This section provides a general summary of the disclosure, and is not a comprehensive disclosure of its full scope or all of its features.

In an aspect of the present disclosure, a sign apparatus is provided and comprises a light source operable to emit light, a front panel having a front portion and a side portion, and a rear panel attached to the front panel and having a back portion, a side portion and a rim portion. The front portion of the front panel is configured to have translucent properties to pass light emitted from the light source. The rim portion of the rear panel is configured to have opaque properties to block light emitted from the light source, and the back portion of the rear panel is configured to have translucent properties to pass light emitted from the light source. The rear panel and the front panel define a cavity, and the light source is housed in the cavity. The side portion of the front panel extends between the cavity and the side portion of the rear panel, and the rim portion of the rear panel is configured to follow a contour of the front panel and extend beyond a periphery of the front panel. In another variation, the rim portion may be located on the front panel instead of the rear panel. In still another variation, both the front panel and the rear panel includes the rim portion.

In another aspect of the present disclosure, a sign apparatus is provided and comprises a plurality of light sources operable to emit light, a plurality of front panels, and a rear panel attached to the plurality of front panels and having a plurality of shaped members. Each of the plurality of front panels has a front portion that is configured to have translucent properties and a side portion. Each of the shaped members has a back portion that is configured to have translucent properties, a rim that is configured to have properties opaque, and a side portion. Two adjacent shaped members from among the plurality of shaped members are connected to each other by way of a link member that extends between the rims of the two adjacent shaped members. A given shaped member from among the plurality of shaped members is attached to a respective front panel from among the plurality of front panels and forms a cavity with the respective front panel. The rim of the given shaped member extends from the side portion away from the cavity. The side portion of the respective front panel extends between the cavity and the rim of the given shaped member. At least one light source from among the plurality of light sources is disposed in the cavity.

In yet another aspect of the present disclosure, a sign apparatus is provided to include a plurality of light source operable to emit light, a front panel, and a rear panel attached to the front panel. The front panel has a front portion and the side portion which are configured to have translucent properties. The rear panel has a back portion, a side portion, and a rim extending from the side portion. The back portion of the rear panel is configured to have translucent properties and the rim is configured to have opaque properties. The rear panel and the front panel define a cavity, and the light sources are disposed in the cavity. The rim is configured to follow a contour of the front panel and extends beyond a periphery of the front panel. The side portion of the front panel is arranged between the cavity and the side portion of the rear panel.

Further areas of applicability will become apparent from the description provided herein. It should be understood that the description and specific examples are intended for purposes of illustration only and are not intended to limit the scope of the present disclosure

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
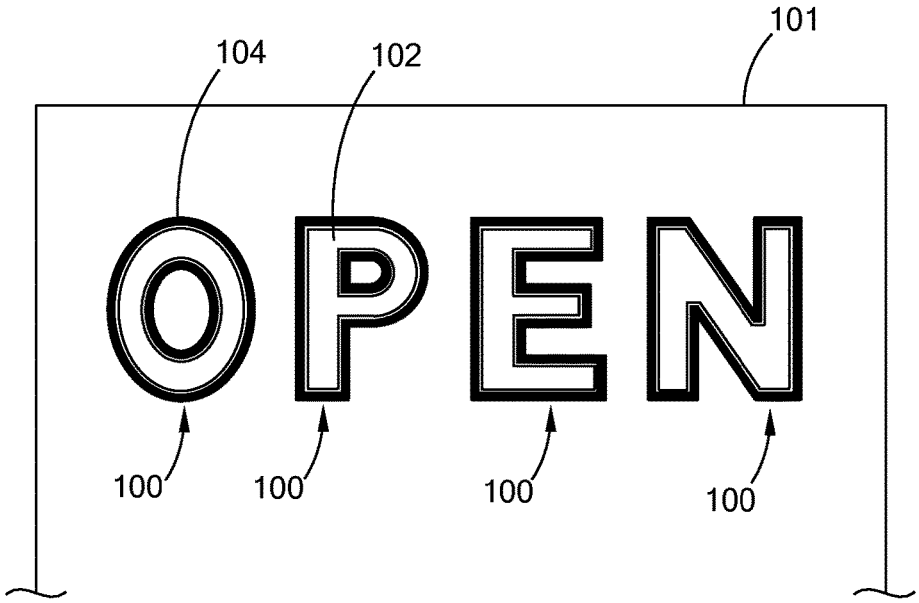
FIG. 1 is a perspective view of a sign apparatus in a first embodiment of the present disclosure.

The present disclosure will now be described with reference to the accompanying drawings. FIG. 1 illustrates a sign apparatus 100 mounted on a wall 101, and made of characters and/or symbols for conveying information. The sign apparatus 100 of the present disclosure may be designed to convey various information and is not limited to the logo depicted in the figures.

The sign apparatus 100 includes a front panel 102 and a rear panel 104, which are collectively referred to as panels 102 and 104. The front panel 102 is a front face of the sign apparatus 100, and the rear panel 104 is positioned behind the front panel 102. The panels 102 and 104 may be made of plastic and formed using, for example, thermoforming in which a plastic sheet is heated to a pliable forming temperature and formed to a specific shape in a mold. The plastic sheet may be configured in various suitable colors and transparency. For example, a clear plastic sheet may be formed with a color film disposed thereon to create a colored plastic panel. Alternatively, a colored plastic sheet may be used to create the panel. Other suitable plastic forming processes may also be used to construct the panels 102 and 104.

Figure 2:
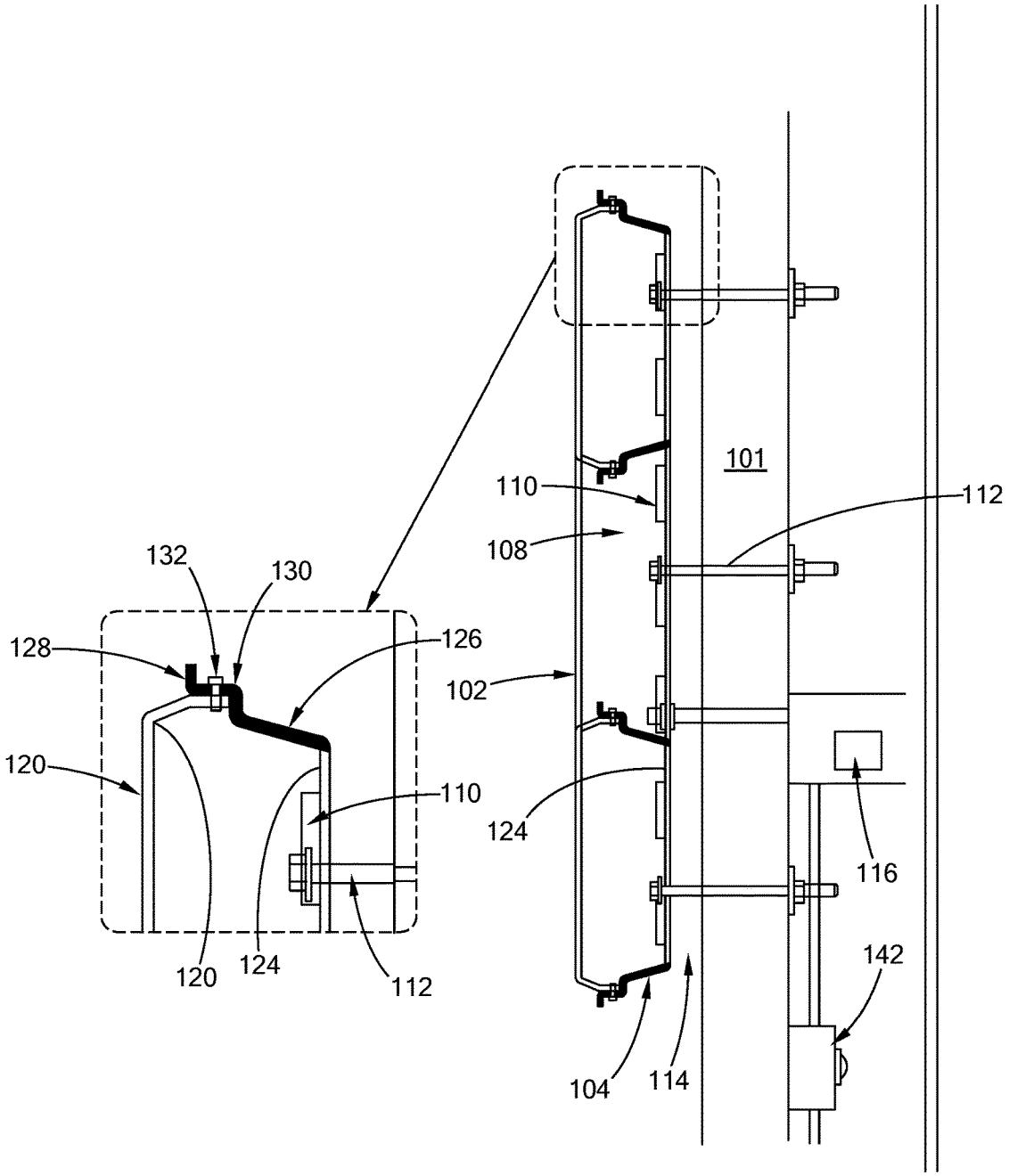
FIG. 2 is a cross-sectional view of the sign apparatus of FIG. 1.

With reference to FIG. 2, a cross-sectional view of the sign apparatus 100 is provided. In the example embodiment, the front panel 102 and the rear panel 104 define a cavity 108 in which one or more light sources 110 are disposed. The light sources 110 may be light emitting diodes (LEDs) that are arranged within the cavity 108 and operable to emit light.

In the example embodiment, the sign apparatus 100 is mounted to the wall 101 by way of one or more fasteners 112. The sign apparatus 100 may be positioned away from the wall 101 such that a gap 114 is provided between the rear panel 104 and the wall 101.

The sign apparatus 100 may include an electrical box 116 that is electrically coupled to a power supply 142, such as an electrical outlet. The electrical box 116 may include a switch (not shown) and other electrical components for supplying power to the light sources 110 in the sign apparatus 100. That is, the electrical box 116 may be configured in various suitable ways for supplying power to the light source 110. For example, the electrical box 116 may include a main switch that is manually operable by a user for turning the light sources 110 ON/OFF. Alternatively, in lieu of or in addition to the switch, the electrical box 116 may include a processor that is programed to turn the light sources 110 ON/OFF at preset times.

The front panel 102 includes a front portion 120 and a side portion 122 that extends away from the front portion 120. The front portion 120 is translucent for transmitting and/or diffusing light emitted by the light sources 110. The side portion 122 may be configured in a similar manner as the front portion 120, and therefore, may also be translucent and of the same color as the front portion 120. Alternatively, the side portion 122 may be configured differently, such as being a different color and/or being opaque to reflect and/or absorb the light emitted. The side portion 122 may also be referred to as a front side portion 122.

The rear panel 104 includes a back portion 124, a side portion 126, and a rim 128. The side portion 126 may include a step 130 that is adjacent to the rim 128. The side portion 126 and the rim 128 may be opaque to absorb and/or reflect light from the light source. The side portion 126 may also be referred to as a rear side portion 126.

The back portion 124 may be translucent for transmitting and/or diffusing light emitted by the light sources 110 and may be, for example, clear or have a color film that has light transmitting properties. The light sources 110 may be positioned and attached along the back portion 124 of the rear panel 104, and the fastener 112 may extend through the back portion 124 to attach the sign apparatus 100 to the wall 101.

In the example embodiment, with the front panel 102 attached to the rear panel 104, the front side portion 122 is between the cavity 108 and the rear side portion 126. More particularly, sections of the front side portion 122 and the rear side portion 126 extend parallel with each other between the rim 128 and the step 130, and the end of the front side portion 122 may abut with the step 130. The rim 128 extends from the rear side portion 126 toward a direction opposite of the cavity 108. The rim 128 is configured to follow the contour of the front panel 102 and extend beyond a periphery of the front panel 102, thus forming a border around the front panel 102.

The front panel 102 and the rear panel 104 are attached by way of one or more fasteners 132 that are located between the step 130 and the rim 128 and extend through the rear side portion 126 and the front side portion 122. The fasteners 132 may be behind the rim 128 and thus, not visible to a viewer when the sign apparatus 100 is viewed in a direction toward the front panel 102. The interface between the front panel 102 and the rear panel 104 may be weatherproofed by a seal to prevent water and/or other debris from entering the cavity 108. For example, a neoprene seal may be provided between the step 130 and the front side portion 122 of the front panel 102.

With the light sources 110 emitting light, the front panel 102 and the wall 101 are illuminated and a contrasting unilluminated region is disposed therebetween. Specifically, light incident on the translucent portions of the front panel 102 generates a glow or, in other words, illuminates the front panel 102. Likewise, light incident on the back portion 124 of the rear panel 104 illuminates the wall 101 to form a halo or, in other words, a glow around the sign apparatus 100. In the example embodiment, the contrasting unilluminated region is formed by the rear side portion 126 and the rim 128 which are opaque and thus, reflect or absorb light. In addition, the rim 128 extends beyond the front panel 102 blocking light from the front panel 102 from interfering with the light of the halo and thus, forming a distinct outline around the front panel 102 when the sign apparatus is viewed in a direction toward the front panel 102. By way of example, if the illumination of the front panel is of similar or a different color than the halo, the characters of the sign apparatus 100 may appear dull because the illumination from the front panel 102 and the halo may blend with each other. With the rim 128 of the present disclosure, the sign may appear sharper and well defined because the rim 128 outlines the characters of the sign, and acts as a barrier to partially block the illumination from the front panel 102 and from the halo.

In the first embodiment, the rear panel 104 has the rim 128 and the step 130 for receiving the front panel 102. Alternatively, with reference to FIG. 3, in a second embodiment a sign apparatus 150 may include a front panel 152 that is configured like the rear panel 104 of the first embodiment and a rear panel 154 that is configured like the front panel 102. More particularly, in addition to the front portion 120, the front panel 152 includes a side portion 156 having a step 158 and a rim 160 extending from the side portion 156. With regard to the rear panel 154, in addition to the back portion 124, the rear panel 154 includes a side portion 162, but does not include a rim.

In the example embodiment, the rim 160 is provided with the front panel 152 to form the contrasting region between the illuminated front panel 152 and the halo. Accordingly, the front portion 120 is translucent and the rim 160 is opaque. The side portion 156 of the front panel 152 may be translucent, opaque or both such that some sections of the side portion 156 are translucent and other sections are opaque.

Figure 3:
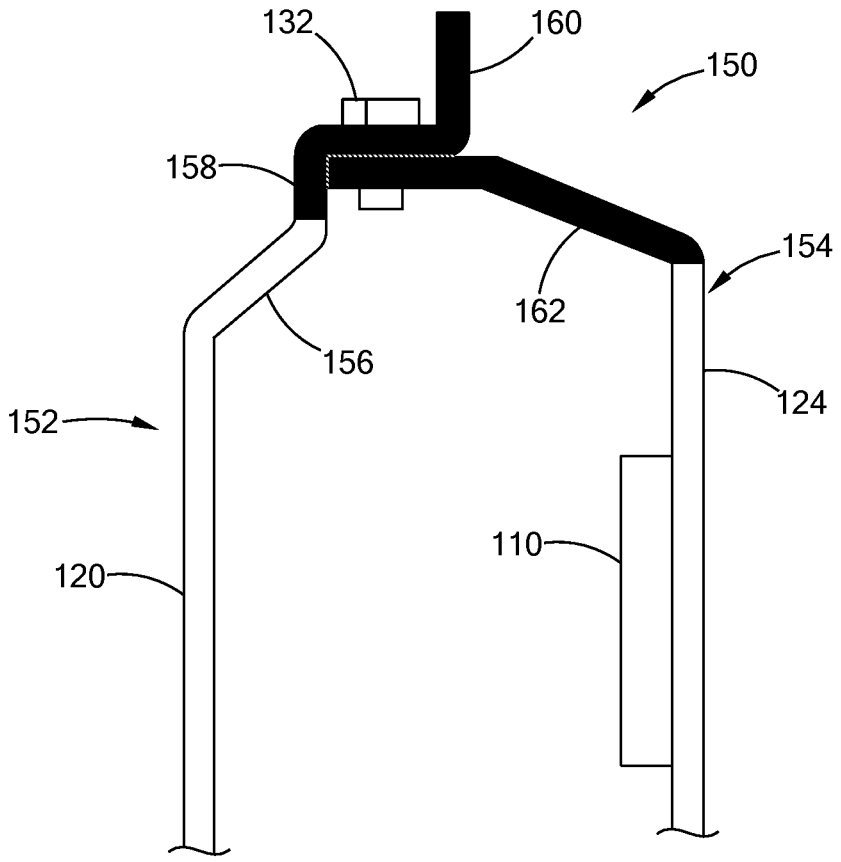
FIG. 3 is a cross-sectional view of a sign apparatus in a second embodiment of the present disclosure.
Figure 4:
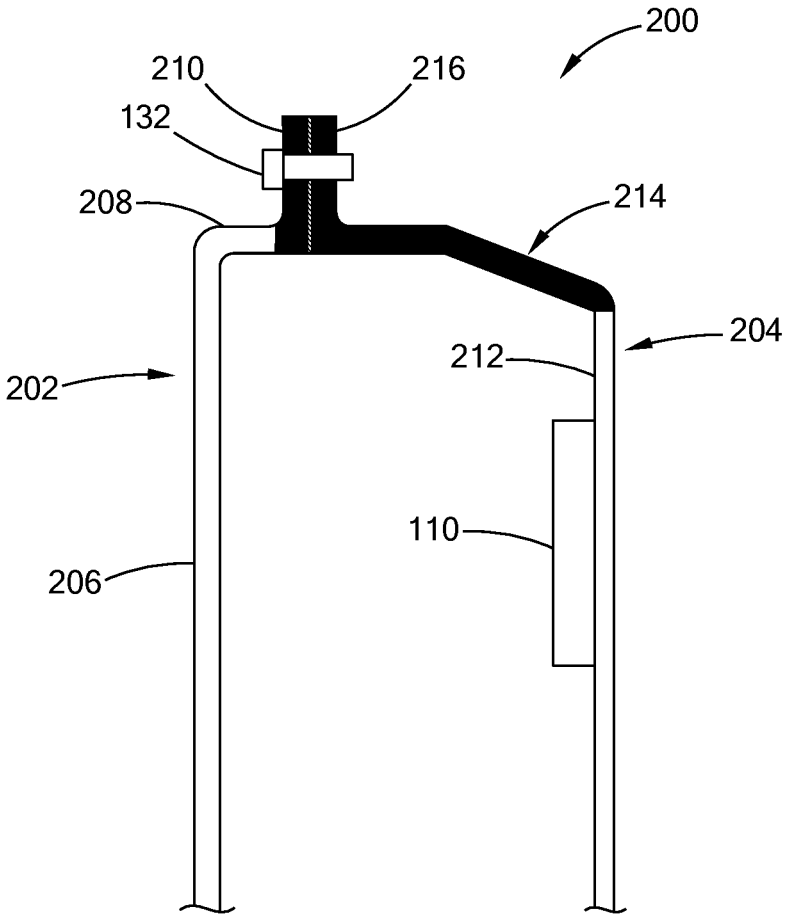
FIG. 4 is a cross-sectional view of a sign apparatus in a third embodiment of the present disclosure.

The sign apparatuses of the first and second embodiments have one rim provided on one of the panels. With reference to FIG. 4, in a third embodiment, a sign apparatus 200 may include rims on both of the panels. As shown in FIG. 3, the sign apparatus 200 includes a front panel 202 and a rear panel 204. The front panel 202 includes a front portion 206, a side portion 208, and a rim 210. The rear panel 204 includes a back portion 212, a side portion 214, and a rim 216. The rim 210 extends parallel with the rim 216, and the fastener 132 is attached to the rims 210 and 216 to fasten the front panel 202 and the rear panel 204 to each other.

For the front panel 202, the front portion 206 and the side portion 208 are translucent, and the rim 210 is opaque. For the rear panel 204, the back portion 212 is translucent, and the side portion 214 and the rim 216 are opaque. Light emitted from the light sources 110 passes through the front portion 206 and the side portion 208 of the front panel 202, and from the back portion 212 of the rear panel 204. The rim 210 of the front panel 202 and the side portion 214 and the rim 216 of the rear panel 204 form the contrasting region between the illuminated front panel and the halo illuminated by the light passing through the back portion 212. Accordingly, a well-defined outline is formed around the front panel 202.

Figure 5A:
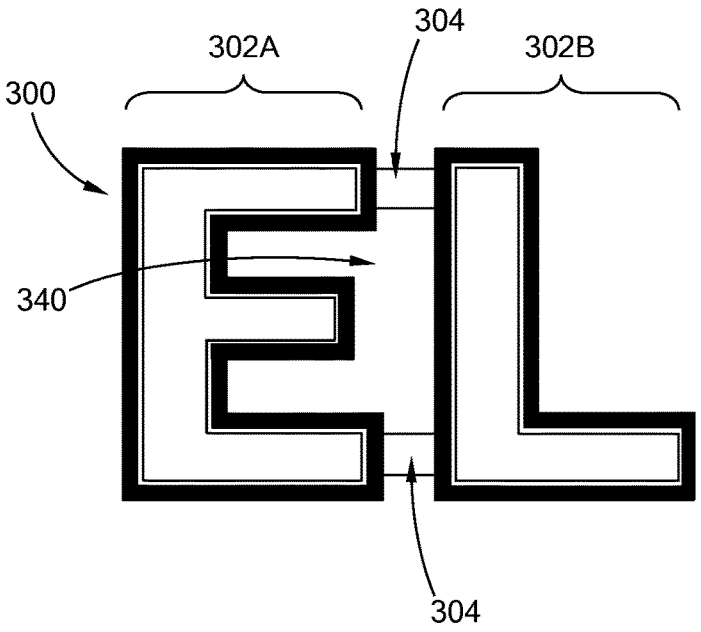
FIGS. 5A and 5B illustrate a sign apparatus in a fourth embodiment of the present disclosure.
Figure 5B:
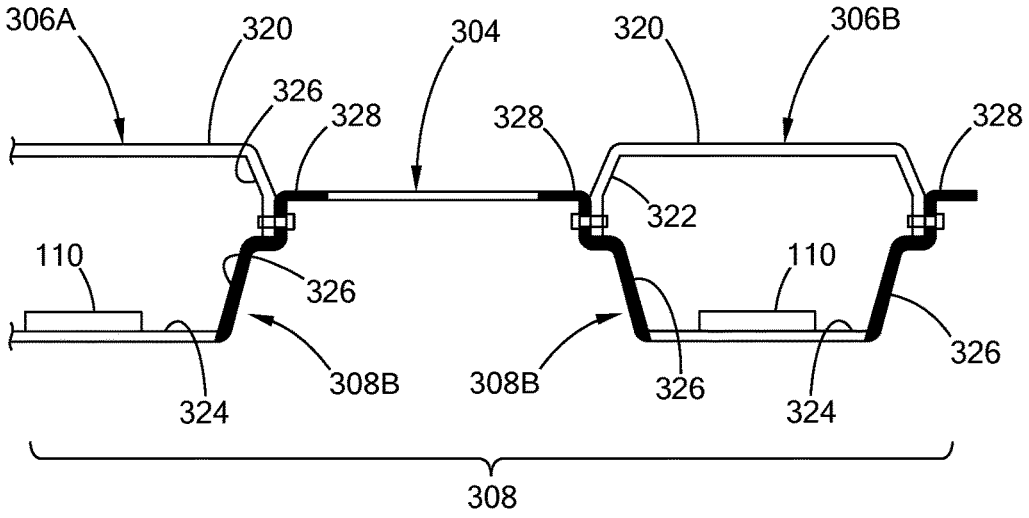

The sign apparatus of the present disclosure may be used to form a single letter or character. For example, in FIG. 1, each letter (i.e., "O" "P" "E" "N") may be considered a separate sign apparatus 100 to form the word "OPEN". Alternatively, in a fourth example embodiment of the present disclosure, a single sign apparatus may be configured to convey multiple characters and/or shapes. As an example, with reference to FIGS. 5A and 5B, a sign apparatus 300 includes sections 302A and 302B that are joined together by one or more bridge sections or link members 304. The sections 302A and 302B may be collectively referred to as sections 302.

In the example embodiment, the section 302A is configured as the letter "E" and the section 302B is configured as the letter "L". While the sign apparatus 300 includes two sections, the sign apparatus 300 may include additional sections that are joined via the bridge sections 304. In addition, the different sections of the sign apparatus 300 may be formed in various combinations of characters and/or symbols, and should not be limited to the example provided herein (i.e., not limited to "EL").

In the example embodiment, the sign apparatus 300 includes a front panel 306A for section 302A, a front panel 306B for section 302B, a rear panel 308, and the light source 110 positioned between the front panels 306A and 306B and the rear panel 308. The front panels 306A and 306B may be collectively referred to as front panels 306. Similar to the first embodiment, each of the front panels 306 includes a front portion 320 that is translucent and a side portion 322 that may be translucent and/or opaque.

The rear panel 308 includes one or more shaped members that are attached via the bridge sections 304 and coincide with the front panels 306 of the sign apparatus 300. For example, in the example embodiment, the rear panel 308 includes shaped members or sections 308A and 308B for sections 302A and 302B, respectively, and the bridge sections 304. The shaped members 308A and 308B may be collectively referred to as shaped members 308. Each of the shaped members 308 includes a back portion 324, a side portion 326, and a rim 328. Like the first embodiment, the back portion 324 is translucent for transmitting light from the light source 110, and the side portion 326 and the rim 328 are opaque to prevent light from passing through.

In the example embodiment, the shaped members 308 are connected to each other via the bridge sections 304. That is, two adjacent shaped members 308 are aligned and attached to each other via the bridge sections 304 that extends between the rims 328 of the shaped member 308. The bridge sections 304 may be translucent or opaque depending on the requirements of the sign apparatus.

In the example embodiment, the rear panel 308 defines a gap or hole 340 between the rims 328 of the shaped members 308 in regions not having the bridge section 304. Alternatively, the sign apparatus 300 may be configured to have a continuous bridge section that joins the rims 328 of the sections 302A and 302B, such that there is no gap 340.

In addition to the benefits of the sign apparatus of the first embodiment, the sign apparatus 300 of the third embodiment can provide two or more characters/symbols that are joined together and formed out of one rear panel 308. Thus, decreasing the complexity and cost of the sign apparatus. In addition, the bridge section of the sign apparatus 300 aligns the characters/symbols with more accuracy than when each character/symbols is a separate sign apparatus that are manually aligned when mounted to, for example, a wall. Thus, there is little to no variation in the alignment of the characters of the sign apparatus 300.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth, such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail.

What is claimed is:

1. A sign apparatus comprising:

a light source operable to emit light;

a front panel having a front portion and a side portion, wherein the front portion is configured to have translucent properties to pass light emitted from the light source; and a rear panel attached to the front panel and including a back portion, a side portion, and a rim portion, wherein the rim portion is configured to have opaque properties to block light emitted from the light source, and the back portion is configured to have translucent properties to pass light emitted from the light source, further wherein:

the rear panel and the front panel define a cavity, and the light source is housed in the cavity, the side portion of the front panel extends between the cavity and the side portion of the rear panel, and the rim portion is configured to follow a contour of the front panel and extend beyond a periphery of the front panel.

2. The sign apparatus of claim 1, wherein the side portion of the rear panel has a step that is configured to interface with the side portion of the front panel.

3. The sign apparatus of claim 1 further comprising a fastener fastening the front panel with the rear panel, wherein the fastener is disposed between the rim portion and the back portion of the rear panel and extends through the side portions of the rear panel and the front panel.

4. The sign apparatus of claim 1, wherein the back portion of the rear panel is clear.

5. The sign apparatus of claim 1, wherein the side portion of the front panel is configured to have translucent properties.

6. The sign apparatus of claim 1, wherein the side portion of the front panel is configured to have opaque properties.

7. The sign apparatus of claim 1, wherein the rim portion is configured to follow a contour of the front panel and extend beyond a periphery of the front panel.

8. The sign apparatus of claim 1, wherein the front panel is configured to diffuse and transmit the light emitted by the light source.

9. A sign apparatus comprising:

a plurality of light sources operable to emit light;

a plurality of front panels, wherein each of the plurality of front panels includes a front portion that is configured to have translucent properties and a side portion; and a rear panel attached to the plurality of front panels and having a plurality of shaped members, wherein:

each of the shaped members includes a back portion that is configured to have translucent properties, a rim that is configured to have properties opaque, and a side portion, two adjacent shaped members from among the plurality of shaped members are connected to each other by way of a link member that extends between the rims of the two adjacent shaped members, a given shaped member from among the plurality of shaped members is attached to a respective front panel from among the plurality of front panels and forms a cavity with the respective front panel, the rim of the given shaped member extends from the side portion away from the cavity, the side portion of the respective front panel extends between the cavity and the rim of the given shaped member, and at least one light source from among the plurality of light sources is disposed in the cavity.

10. The sign apparatus of claim 9, wherein the rim of the given shaped member follows the contour of the respective front panel and extends beyond a periphery of the front panel.

11. The sign apparatus of claim 9, wherein the rear panel defines one or more holes between the two adjacent shaped members.

12. The sign apparatus of claim 9, wherein the link member extends between the two adjacent shaped members at designated portions of the rims to align the adjacent shaped members along one or more axes, and a hole is defined between the two adjacent shaped members at regions outside of the designated portions of the rims.

13. The sign apparatus of claim 9, wherein the link member is configured to be transparent.

14. The sign apparatus of claim 9, wherein the side portion of the given shaped member has a step that is configured to interface with an end of the side portion of the respective front panel.

15. The sign apparatus of claim 9 further comprising a plurality of fasteners connecting the plurality of front panels with the rear panel, wherein the fasteners are disposed between the rims and the back portions of the rear panel.

16. The sign apparatus of claim 9, wherein the side portion of the rear panel is configured to have opaque properties.

17. A sign apparatus comprising:

a plurality of light source operable to emit light;

a front panel having a front portion and a side portion, wherein the front portion and the side portion are configured to have translucent properties; and a rear panel attached to the front panel and having a back portion, a side portion, and a rim extending from the side portion, wherein the back portion is configured to have translucent properties and the rim is configured to have opaque properties, further wherein:

the rear panel and the front panel define a cavity, and the light sources are disposed in the cavity, the rim is configured to follow a contour of the front panel and extend beyond a periphery of the front panel, and the side portion of the front panel is arranged between the cavity and the side portion of the rear panel.

18. The sign apparatus of claim 17, wherein the side portion of the rear panel has a step that is configured to operate as a stop for an end of the side portion of the front panel.

19. The sign apparatus of claim 17 further comprising a fastener fastening the front panel and the rear panel, wherein the fastener is disposed between the rim and the back portion of the rear panel and extends through the side portions of the rear panel and the front panel.

20. The sign apparatus of claim 17 further comprising:

a plurality of the front panels; and a plurality of the rear panels, wherein:

a given rear panel is attached to one of the front panels, two adjacent rear panels among the plurality of the rear panels are connected to each other by a link member extending between the rims of the two adjacent rear panels, and a hole is defined between the two adjacent rear panels at regions outside of the link member.

* * * * *